US007665601B2

(12) United States Patent
Portier

(10) Patent No.: US 7,665,601 B2
(45) Date of Patent: Feb. 23, 2010

(54) DEHYDRATING CONTAINER COMPRISING A HUMIDITY STATE INDICATOR

(75) Inventor: Benoit Portier, Bourges (FR)

(73) Assignee: AIRSEC, Choisy le Roi (FR)

( * ) Notice: Subject to any disclaimer, the term of this patent is extended or adjusted under 35 U.S.C. 154(b) by 484 days.

(21) Appl. No.: 11/624,481

(22) Filed: Jan. 18, 2007

(65) Prior Publication Data

US 2007/0193891 A1 Aug. 23, 2007

(30) Foreign Application Priority Data

Jan. 18, 2006 (FR) ..... 06 00437

(51) Int. Cl.
*B65D 81/26* (2006.01)

(52) U.S. Cl. ..... 206/204; 206/459.1

(58) Field of Classification Search ..... 206/204, 206/459.1, 528, 701, 538, 539; 53/447, 471, 53/485; 116/200, 216
See application file for complete search history.

(56) References Cited

U.S. PATENT DOCUMENTS

| | | | | |
|---|---|---|---|---|
| 2,460,065 | A | 1/1949 | Bell | |
| 2,460,069 | A | 1/1949 | Bell | |
| 2,460,070 | A | 1/1949 | Bell | |
| 2,460,071 | A | 1/1949 | Bell | |
| 2,460,073 | A | 1/1949 | Bell | |
| 2,460,074 | A | 1/1949 | Bell | |
| 4,013,566 | A | 3/1977 | Taylor | |
| 4,061,807 | A | 12/1977 | Shaler et al. | |
| 4,407,897 | A | 10/1983 | Farrell et al. | |
| 4,665,050 | A | 5/1987 | Degen et al. | |
| 4,792,484 | A | 12/1988 | Moritani | |
| 4,990,284 | A | 2/1991 | Lauterbach et al. | |
| 5,078,909 | A | 1/1992 | Shigeta et al. | |
| 5,293,996 | A * | 3/1994 | Duncan | 206/459.1 |
| 5,318,181 | A * | 6/1994 | Stover et al. | 206/459.1 |
| 5,401,706 | A | 3/1995 | Fischer | |
| 5,432,214 | A | 7/1995 | Lancesseur | |
| 5,496,397 | A | 3/1996 | Fischer et al. | |
| 5,591,379 | A | 1/1997 | Shores | |
| 5,644,899 | A * | 7/1997 | Truesdale | 53/447 |
| 5,788,064 | A * | 8/1998 | Sacherer et al. | 206/204 |
| 5,875,892 | A * | 3/1999 | Martin et al. | 206/459.1 |
| 6,530,472 | B2 * | 3/2003 | Hacikyan | 206/204 |
| 6,827,218 | B1 | 12/2004 | Dick et al. | |

(Continued)

FOREIGN PATENT DOCUMENTS

| | | |
|---|---|---|
| DE | 4013799 | 10/1991 |

(Continued)

*Primary Examiner*—Luan K Bui
(74) *Attorney, Agent, or Firm*—Scott R. Cox

(57) ABSTRACT

A dehydrating container made of a thermoplastic polymer suitable for packaging products sensitive to ambient humidity, said containing comprising: a visual humidity state indicator, a container body forming a casing, closed at one of its ends by a base and open at another end thereof, a reclosable closure capable of cooperatively fitting on the open end of said casing, optionally, a connector placed between the closure and the casing, and a humidity absorber inside the containing for absorbing humidity from the atmosphere inside the container. The absorber comprises a dehydrating agent and the reclosable closure comprises a visual humidity state indicator that changes color according to the existing humidity level and/or to a maximum humidity level. The visual indicator is advantageously located on an internal surface of the closure.

19 Claims, 4 Drawing Sheets

U.S. PATENT DOCUMENTS

| | | | | |
|---|---|---|---|---|
| 2002/0179460 | A1 * | 12/2002 | Kitamura et al. | 206/204 |
| 2005/0016873 | A1 * | 1/2005 | Belfance et al. | 206/204 |

FOREIGN PATENT DOCUMENTS

| | | |
|---|---|---|
| EP | 432438 | 6/1991 |
| WO | WO 01/09601 | 2/2001 |
| WO | WO 03/015060 | 2/2003 |

* cited by examiner

DEHYDRATING CONTAINER COMPRISING A HUMIDITY STATE INDICATOR

CROSS REFERENCE TO RELATED APPLICATIONS

This application claims priority from FR 0600437 filed Jan. 18, 2006, the content of which is incorporated herein by reference in its entirety.

BACKGROUND OF THE INVENTION

1. Field of the Invention

The present invention relates generally to impervious dehydrating containers that include reclosable caps.

2. Description of Related Art

Humidity-sensitive products that should be packaged in a controlled-atmosphere environmental medium include, in particular, products that desirably need to be protected so that their efficacy does not change due to a reaction with the humidity present in the ambient gaseous atmosphere and/or so that their physical integrity is preserved over time. In addition, it is often desirable to protect such products in order to avoid a change in their mechanical cohesion or their chemical behavior.

Packaging developed for such products usually comprises dehydrating materials such as, for example, silica gel and/or molecular sieves, which have the ability to act as a dehydrator of ambient gases inside the casing. Such casings are typically designed to be as impervious as possible.

A practice described in WO 03015060 involves verifying the humidity content inside a package by means of an indicator in direct contact with the ambient atmosphere of the package. The assembly includes an indicator tag formed by a soluble ink that is capable of migrating based on changes in the humidity content on a porous medium. The indicator tag can be seen through an opening present in the package, but is protected from the external atmosphere by a transparent protective layer impermeable to steam. An observer can thus visually see the migration of the ink and therefore determine if the packaged product has deteriorated. Such a design is complex because it requires the juxtaposition of a plurality of layers of which some, transparent and impermeable. This is difficult to implement in the case of containers produced at high speed by injection molding techniques from so-called convenience thermoplastic materials, which are often used to reduce the costs. In addition, as some products are sensitive to light, the inclusion of a viewing window can be unsuitable in some cases.

U.S. Pat. No. 4,990,284 describes a similar practice concerning the verification of the humidity content of a product packaged in a steam-proof impermeable transparent external casing, comprising, on the internal surface an indicator in the form of an impression produced with an ink having the ability to change color depending on the ambient humidity. It is necessary to remember that any casing, for example an overwrapping such as a film coated with strong barrier materials, allows humidity to pass over the long term, in particular through seams. The overwrapping overlapping the first primary packaging in contact with the product to be protected is permanently broken at the time of the first opening. Therefore, this approach is not suitable for the aforementioned need to view a humidity state of an enclosed gaseous medium, during recurrent uses, but is to be considered to be an indicator of the state at the first opening only.

Another practice described in document WO 0109601 consists of knowing the hygrometric state of a dehydrating material acting as a humidity sensor inside a package. A silica gel or an amorphous silica acting as the dehydrating material is impregnated with a copper salt-based ionic composition having the ability to change color according to the humidity state around the ionic composition.

Furthermore, this same document describes a paper or non-woven tag that constitutes a medium impregnated or coated with an ionic solution containing a copper salt capable of changing color according to the ambient humidity content. Ionic solutions can have different concentrations in order to control the changes in hue. Such materials, paper and woven or non-woven textiles generally make it possible to package granular dehydrating materials. This approach by impregnation of a support is suitable for observing the change in the dehydrating agent thus packaged.

U.S. Pat. No. 5,293,996 describes a package for integrated circuits containing a humidity indicator of which the color changes according to the hygrometric change, visible from the outside by a window incorporated in the package. The humidity indicator is positioned inside the package to the right of this window. The container is divided into three sections and one of these sections contains a compartment housing the humidity indicator. The humidity indicator is preferably a card. The card is simply placed in the compartment, thus making it visible from the outside. The composition of the packaging material of the compartment containing the humidity indicator card is a transparent plastic that enables the humidity indicator card to be viewed from the outside of the container.

U.S. Pat. No. 6,827,218 also describes a container for humidity-sensitive electronic equipment, such as, for example, an integrated circuit, including a tray, in which the integrated circuit is located, a cover that is attached to the tray, said cover being made of at least one dehydrating thermoplastic composition consisting of a polymer material, a dehydrating material and, in addition, an electrostatic charge dissipating material. The tray and cover constitute a primary package. This cover comprises an opening closed by an additional transparent part, to which the humidity indicator is attached on the internal side.

The primary package equipped with its indicator is placed in a secondary, flexible, transparent, barrier package, protecting the primary package, and in particular the dehydrating cover of which the main function is to dehydrate both the contents of the primary package as well as the gaseous volume located between the primary package and the secondary protective overwrapping. Therefore, the primary container is not impervious to humidity, and its dehydrating cover is there to keep the humidity level of said container as low as possible.

Moreover, such packages are difficult to implement, and while they may be suitable for integrated circuit-type products, with additional functionalities such as electrostatic discharge, they are not suitable for convenience products packaged in disposable packages and therefore that must be produced in large numbers and at the lowest costs.

SUMMARY OF THE INVENTION

Therefore, there was a need for an impervious dehydrating container, equipped with a reclosable closure or cap ensuring imperviousness. A container of the present invention comprises a dehydrating material capable of absorbing an excess of humidity in the chamber of the container once it has been filled. Since there are often successive openings and closings between the sequences of use of the products in the container, the present invention advantageously provides a visual indicator that makes it possible to determine the hygrometric state of the atmosphere contained in the chamber formed by the closed container each time the product is being used.

There are several objectives associated with a dehydrating container with a humidity state indicator according to the present invention, some of which are described below.

A first objective of the present invention was to produce a dehydrating container comprising a humidity state indicator making it possible to take into account the hygrometric state of the controlled ambient gaseous atmosphere, inside the container, when it is first opened, after filling of the dehydrating container, and at the time of each subsequent opening, and thus to be sure of the remaining efficacy of the dehydrating element inside the container with regard to its ability to store a product that is initially dry and not degraded by the presence of excessive relative humidity of the internal atmosphere.

A second objective of the invention was to incorporate, in the dehydrating container, a reference indicator indicating the humidity state of said dehydrating medium, which is compared with the level of change of the humidity indicator during its exposure in the controlled ambient gaseous atmosphere.

Another objective of the invention was to create a dehydrating container with a reclosable cover-cap comprising a humidity state indicator that can be incorporated in said container so that the assembly can easily be mass produced, with thermoplastic materials and so that said indicator provides an obvious assurance to the user, at the time of the first opening and subsequent openings, of the proper relative humidity state inside the chamber constituted by the closed casing of the package including a reclosable cover-lid.

In accordance with these and other objectives, the present invention is directed to a dehydrating container with a humidity state indicator, made of thermoplastic polymer materials, for packaging products sensitive to ambient humidity, in shaped forms or not. The container comprises:

- a container body forming a casing, closed at one of its ends by a base and open at the other end, to form the mouth constituting the product packaging area,
- means for reclosable closing of the open end of the casing,
- optionally, connection means placed between the closing means and the casing,
- means for absorbing the humidity from the atmosphere inside the container, constituted by a dehydrating agent placed inside said container, and characterised in that the reclosable closing means comprise a visual humidity state indicator in the dehydrating container that changes color according to the existing humidity level or to a maximum humidity level reached, which visual indicator is placed on the internal surface of said reclosable closing means.

A dehydrating container with a humidity state indicator of the present invention is capable of eliminating certain disadvantages of the prior art as well.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

BRIEF DESCRIPTION OF THE DRAWINGS

The invention can be understood best with the description of the figures below, which figures are provided to illustrate, in a non-limiting manner, a specific dehydrating container of the invention.

DETAILED DESCRIPTION OF A PREFERRED EMBODIMENT

Figure 1:
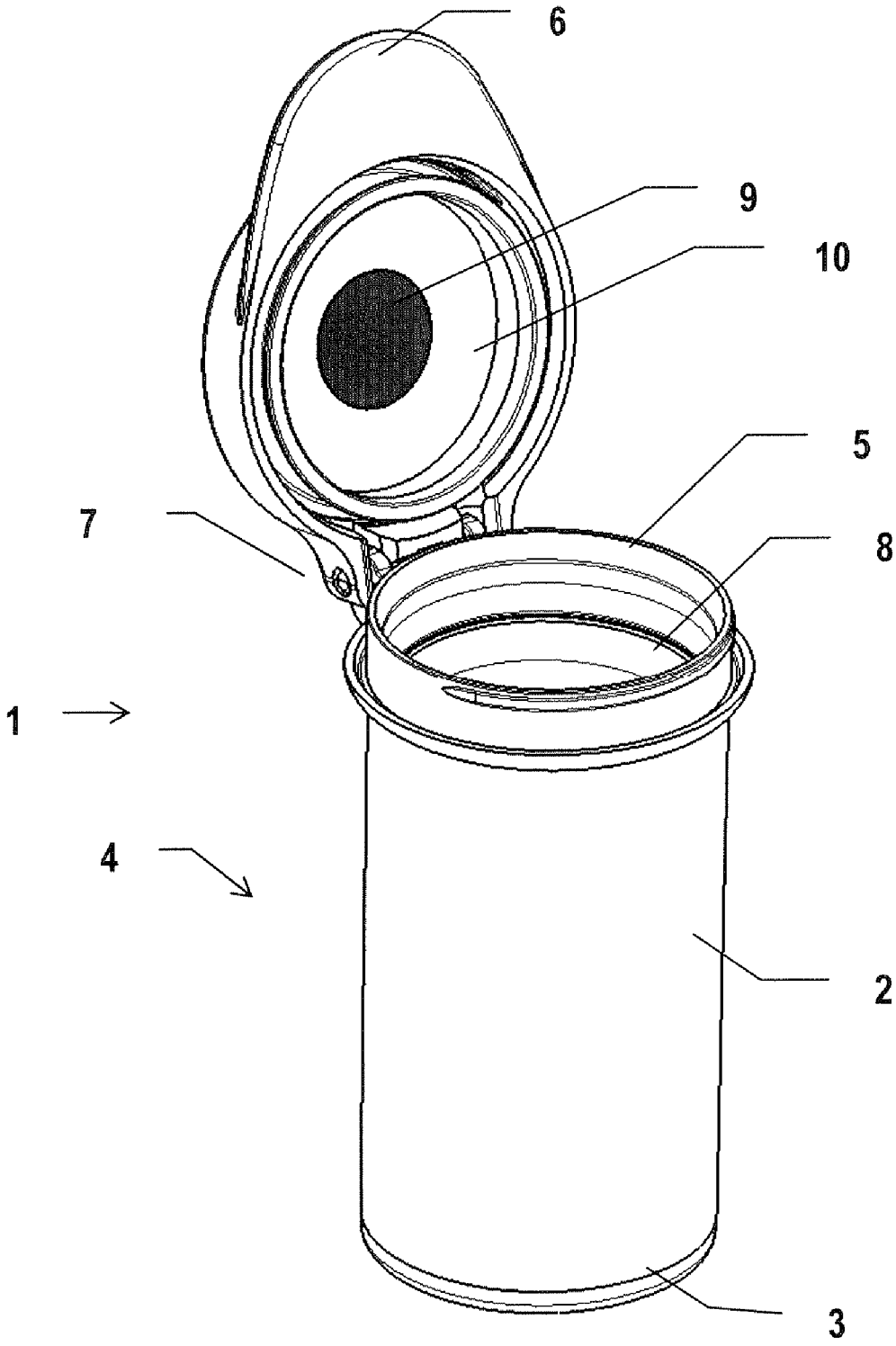
FIG. 1 is a perspective view of a dehydrating container in the semi-open position in which the closing means, constituted by a cover-cap, comprises, on the internal base thereof, a visual humidity state indicator and a permanent visual colored indicator that is chosen in a color scale of which the hues are correlated with pre-established humidity levels, which makes it possible, by comparing its color with the color acquired by the visual humidity state indicator, to determine the humidity level of the atmosphere of the container.
Figure 2:
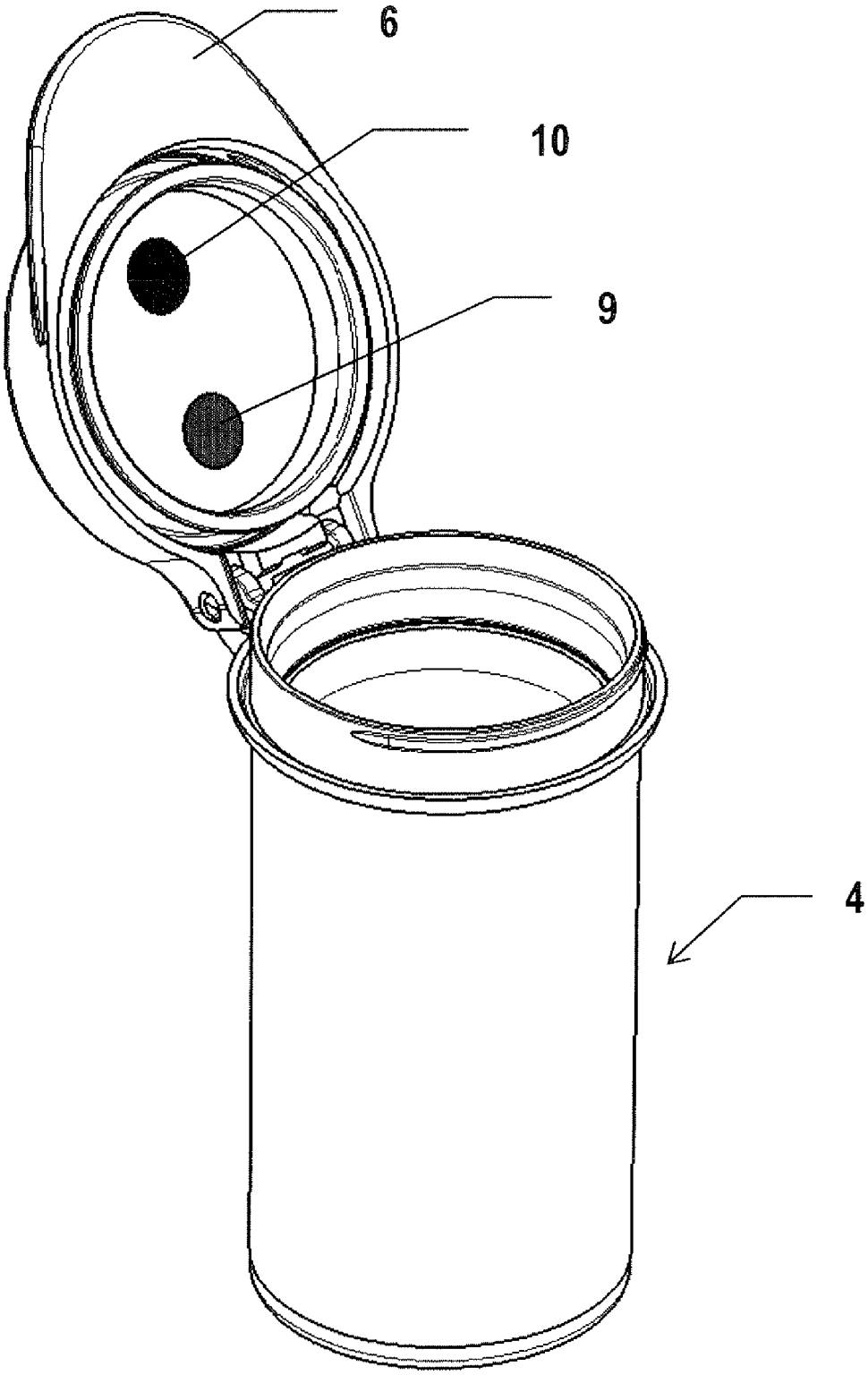
FIG. 2 is a perspective view of a dehydrating container in a semi-open position, in which the cover-cap-type closing means comprises, on the internal base thereof, a visual humidity state indicator and a permanent visual colored indicator.
Figure 3:
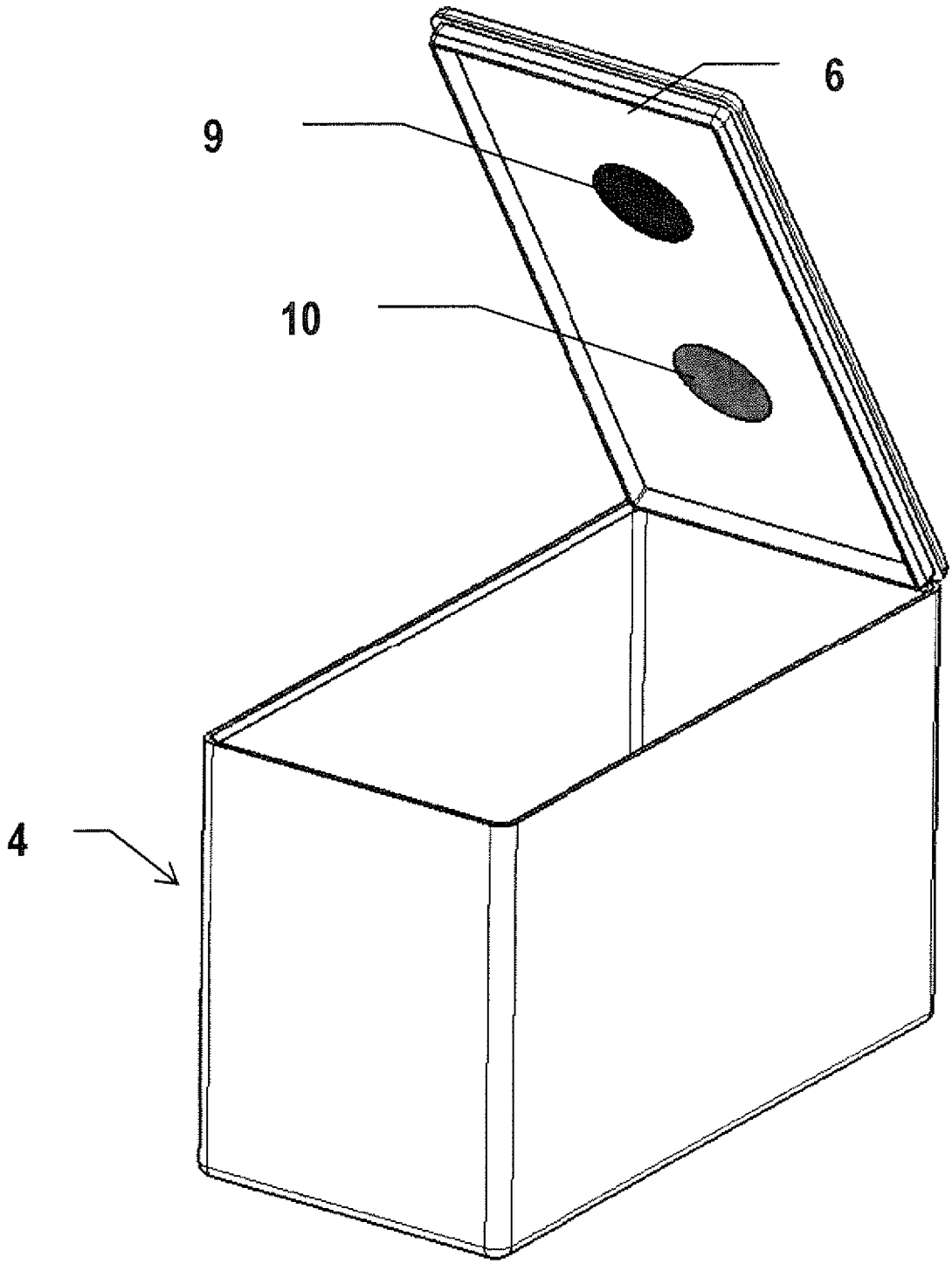
FIG. 3 is a perspective view of a parallelepiped container according to the present invention, in a semi-open position, in which the cover-cap-type closing means comprised, on the internal base thereof, a visual humidity state indicator and a permanent visual colored indicator.

In accordance with the present invention, there is provided a dehydrating container having a humidity state indicator. The internal gas space of the container permits hygrometry to be maintained at a controlled level (which can be as low as possible), and the humidity indicator makes it possible to detect the humidity state of the gaseous medium contained.

In fact, the observation of the state of such an indicator makes it possible to determine whether the products contained are exposed to an atmosphere of which the humidity content is too high.

The invention relates more specifically to an impervious dehydrating container of which the humidity content is controlled, which can have a variety of shapes such as cylindrical, parallelepiped, spherical or more generally with walls defining a volume or a volume portion having planar and/or curved, concave and/or convex surfaces, with an opening that can be opened and closed by a cap, optionally connected to the body of said container, said container being intended in particular for packaging products sensitive to humidity, said container being equipped with a humidity state indicator.

Many products of different types can experience deterioration in terms of quality or be seriously damaged, when exposed, during storage, transportation or use, to excessively moist atmospheres. It is therefore important to check their state prior to use.

These products to be protected can be electric and electronic components and apparatuses, such as, for example, printed circuits or mobile telephones, but can also be food, pharmaceutical and test products. An excessively high humidity content in the ambient storage environment over a long period can indeed result in losses in physical cohesion of lozenges or tablets, when it concerns drugs, or losses in the efficacy of active materials by chemical evolution. The same is true of the active elements of test materials, of which chemical reaction modifications can render the product inactive.

This is why such products are generally placed in packages that are not only impervious, i.e. preventing any exchange between the internal volume and the external atmosphere, but also active, i.e. capable of absorbing the humidity present in the package, humidity that may be present at the time of the first filling, but also introduced when the container is successively opened then closed, and of concentrating this humidity in a dehydrating element, thus enabling the products packaged in such containers to remain sufficiently dry, and therefore of maintaining their characteristics and initial functionalities.

Such packages are well known from the prior art and can take on various forms, depending on the types of products packaged.

The invention relates more specifically to an impervious dehydrating container intended for packaging convenience goods, thus packaged in very long runs, but sensitive to humidity. Such products are provided in such various forms as powders, grains, or other forms or solid objects intended for the agri-food and pharmaceutical industries. These applications more specifically cover drugs in the form of tablets, sugar-coated tablets, lozenges, and diagnostic means such as, for example, tabs. There are needs generally satisfied in terms of reducing the humidity content of the gaseous volume in which these products are packaged, but there are also needs in terms of controlling the humidity of this gaseous volume and needs to monitor their state at the time of their use, because the mode of use of these containers is generally fragmented and spread over a potentially substantial period of time.

The invention finally relates to the use of said dehydrating container for packaging humidity-sensitive products when they are in a protective environmental medium the atmosphere of which must be humidity-controlled; the invention also relates to the use of said dehydrating container for the determination, owing to the indicator, of the humidity state of the medium containing them, and thus the state of the products contained.

According to the present invention, there is provided a dehydrating container made of a thermoplastic polymer suitable for packaging products sensitive to ambient humidity, said containing comprising: a visual humidity state indicator, a container body forming a casing, closed at one of its ends by a base and open at another end thereof, a reclosable closure capable of cooperatively fitting on the open end of said casing, optionally, a connector placed between the closure and the casing, and a humidity absorber inside the containing for absorbing humidity from the atmosphere inside the container. The absorber comprises a dehydrating agent and the reclosable closure comprises a visual humidity state indicator that changes color according to the existing humidity level and/or to a maximum humidity level. The visual indicator is advantageously located on an internal surface of the closure.

According to the invention, there if provided a dehydrating container with a visual humidity state indicator that changes color corresponding to a humidity level. The present container is particularly impervious to humidity and is generally intended for packaging any product including those sensitive to ambient humidity such as pharmaceuticals, drugs, diagnostics, test tabs for diagnostics, agri-foods and the like. A container of the present invention can have any possible shape, such as cylindrical, parallelepiped, spherical or more generally with walls defining a volume or a portion of a volume having planar and/or curved, concave and/or convex surfaces, and has an opening that can be opened and closed by closing means optionally connected to the body of said container.

The body of the container is closed with the closing means, preferably constituted by a cap. This cap of any type and can be an insertion cap, or a cover-cap type connected to the body of the container by means of a hinge or secured to the body of the container by an attachment ring, or secured to the body of the container by an integral hinge in the case of all types of containers such as those described above, or a screw cap in the case of a casing with a circular cross-section.

A closure of the present invention is adapted to close an open end of the casing, and is preferably a cover-cap coaxial to the casing having an upper end wall constituting the cover-cap and two peripheral walls coaxial to the axis of the cover-cap forming between them a deep peripheral groove of which the walls are distanced from one another in order to cover, when the closing means is closed, a peripheral wall of the open end of the casing in order to establish a close and sealed contact between:

- the base of the groove and the peripheral edge of the open end of the casing,
- the internal surface of the internal wall of the groove and the internal surface of the open end of the casing,
- the internal surface of the external coaxial wall of the groove and the external surface of the open end of the casing.

An external peripheral collar-type stop can be created near the open end of the casing, on which the closing means can rest in the closed position.

The optional connection means between the casing and the closing means, which is preferably a cover-cap, can be, for example, a removable mechanical hinge, ensuring the precision of the closure, or an integral hinge if the closure forms a single piece with the body of the container and/or if the closure is attached to the body of the container by an attachment ring wedged onto the body of the container.

It is desirable to create a sufficient and even reinforced seal between the body of the container and the cover-cap. Thus, for example, a cover-cap design with a deep peripheral groove allowing for impervious coverage by means of three peripheral surface-to-surface contact areas of the open end of the casing, provides the desired seal by close surface-to-surface contact, when closing the cover-cap.

To facilitate opening and closing of the cover-cap, the lower edge of the external wall of the groove can be extended by a gripping visor.

To hold the cover-cap in the closed position, the internal surface of the external wall of the groove and the external surface of the external wall of the casing can be equipped with snap-lock means, requiring mechanical stress both to close the cover-cap and to open it.

In the case of a container with a removable rigid mechanical-type hinge, it can be formed in two parts, one integrated with the body of the container, and the other integrated with the closing means.

A dehydrating container according to the present invention comprises humidity absorption means, which can be of any type including transfer-type means and/or dehydrating lining-type means.

When the humidity absorption means are of the transfer type, the dehydrating agent can then be placed in a suitable recess, located on the base of the casing, wherein the recess is closed by a cover or closing means that is preferably not impervious to ambient humidity so as to ensure rapid drying of the humidity-sensitive products packaged in the dehydrating container. The dehydrating agent implemented in the dehydrating container is advantageously chosen from the group consisting of silica gels, molecular sieves or other dehydrating products, in the form of a powder or deposited on a powder medium.

When the humidity absorption means are of the lining type, they then can advantageously have a shape that adjusts to the inside of the container body. This shape can be, for example, one of those described above, and can be positioned any desired way such as coaxially with respect to the container body, adjusted very precisely with respect to the internal surface of said body, capable of slipping freely with respect to the latter, or be slightly wedged on. This shape can also be slightly removed from the internal surface of the container body, and then be adjusted to the container body by means of a plurality of longitudinal ribs parallel to the axis of the container body, ensuring the centring, or possibly by means of the protuberances, corresponding to truncated ribs.

Such a lining can have a height dimension identical to the depth of the container body if desired, and can also be even with the open end of said body, or it can be of another dimension such as smaller.

The lining can have a base that may or may not reach the base of the container body. A spacer can also make it possible to leave a space between the base of the container body and the base of the lining constituting the dehydrating means.

Preferably, the humidity absorption means are of the lining type.

This drying lining is produced by injection techniques using dehydrating compositions. These dehydrating compositions are generally well known and amply described in the form of injectable thermoplastic compositions including polymer materials with which the dehydrating products have been incorporated.

For example, U.S. Pat. No. 5,078,909 incorporated herein by reference describes a dehydrating composition comprising 100 parts by weight of a thermoplastic resin and 5 to 400 parts of a dehydrating agent. Document U.S. Pat. No. 5,432,214, incorporated herein by reference, describes a composition containing a dehydrating agent preferably comprising 50 to 80% by weight of a thermoplastic or thermosetting product, 20 to 50% of a dehydrating agent, 2 to 8% by weight of an elastomer and 1 to 4% by weight of fibres.

EP 432 438, incorporated herein by reference, discloses a dehydrating thermoplastic composition comprising 100 parts of absorbent particles mixed with 10 to 50 parts of plastic particles associated with reinforcement fibres. U.S. Pat. No. 4,061,807, incorporated herein by reference, describes a composition preferably comprising 60 to 95 parts of absorbent granules mixed with 50 to 40 parts of thermoplastic particles. U.S. Pat. No. 5,591,379, incorporated herein by reference, discloses an adhesive material used for packaging microelectronic devices. A dehydrating product is dispersed in a composition that forms the coating or the adhesive. This composition uses different polymers. U.S. Pat. No. 4,013,566, incorporated herein by reference, discloses a dehydrating agent combined with a thermosetting material with two components.

U.S. Pat. Nos. 4,792,484 and 4,407,897, both incorporated herein by reference, disclose the use of EVOH copolymers with specific products containing conventional dehydrating materials. The same applies to U.S. Pat. Nos. 5,496,397 and 5,401,706, both incorporated herein by reference.

U.S. Pat. No. 4,665,050, incorporated herein by reference, discloses a solid dehydrating product made from a polymer composition mixed with humidity absorbing particles to form a dehydrating product.

DE 4 013 799, incorporated herein by reference, discloses a dehydrating insert for containers, in particular for drugs and luxury consumer goods, in which a granular dehydrating agent is integrated in a plastic die.

These instantly cited documents all provide teachings of specific dehydrating compositions that are capable of being used in connection with the present invention.

Thus, the dehydrating lining is produced from a composition preferably including at least one thermoplastic or thermosetting plastic material, and at least one dehydrating material. The dehydrating composition can also contain one or more elastomers, fibres, expansion agents, slip agents, mold release agents, reinforced gripping or adhesion agents, according to the requirements of the procedure.

Well-known plastic materials can be used to form the dehydrating lining and include radical or linear high- and low-density polyethylenes, ethylene copolymers (such as, for example, ethylene-vinyl acetate, ethylene-ethyl acrylate, ethylene-butyl acrylate, ethylene-maleic anhydride, ethylene-alfa olefines), regardless of the mode of polymerisation or modification by grafting, homo- and copolymer propylene, polybuten-1, and polyisobutylene. The polyolefins are, for reasons of cost and convenience, preferably chosen to constitute the die receiving the active dehydrating product.

Other polymer materials can, however, be considered, either as the die or as a die additive, such as polyvinyl chloride, vinyl chloride copolymers, poly-vinylidene chlorides, polystyrenes, styrene copolymers, cellulose derivatives, polyamides, polycarbonates, polyoxymethylenes, polyethylene terephthalates, polybutylene terephthalates, copolyesters, polyphenylene oxides, polymethyl methacrylates, acrylate copolymers, fluorinated polymers, polyphenylene sulphides, polyaryl sulfones, polyaryl ether ketones, polyetherimides, polyimides, thermoplastic elastomers, polyurethanes, phenol resins, melamine resins, urea resins, epoxide resins and unsaturated polyester resins.

Polymer materials biodegradable on, for example, starch bases, are also possible, such as, for example, polylactic acids (PLA).

One or more combinations of these polymers can be used in order to create a porous absorbent die, preferably including a phase also having an ability to absorb humidity by the presence of certain polar groupings, such as polyvinyl alcohols, which are cohesive and easy to implement by plastic processing techniques. Porophoric agents can be used to expand such a die and create open or closed cells.

In a preferred embodiment, the dehydrating lining is prepared from polyolefins.

The dehydrating product is incorporated in the thermoplastic polymer material in a specific compounding operation. The dehydrating product can be one or a mixture of more than one of these products chosen from the group of dehydrating agents such as silica gel, dehydrating clay, activated alumina, calcium oxide, barium oxide, natural or synthetic zeolites, a molecular sieve or the like, or deliquescent salts such as magnesium sulfate, calcium chloride, aluminium chloride, lithium chloride, calcium bromide, zinc chloride or the like.

In a preferred embodiment, a molecular sieve and/or a silica gel are incorporated in the plastic material constituting the die.

The dehydrating lining can constitute a separate object, which is inserted in the casing of the container, or be co-injected with the body of the container, by bi-material injection techniques well known from the prior art, forming a sort of skin inside the container body over all or a portion of the internal surface of said body.

When the dehydrating medium is produced only using dehydrating materials, i.e. dehydrating fillers such as silica gels or molecular sieves, or zeolites, these materials are implemented by mould compression and sintering, or by an organic vinyl, acrylic, epoxy, polyester or urethane binder or an inorganic binder, allowing for a grain-to-grain tangential bond of the mineral composition. Some inorganic binders, for example clay, are also possible.

According to the invention, the visual humidity state indicator that changes color can preferably formed by a preferably hydrophilic substrate on which a humidity-indicating composition is deposited, said indicator being positioned at a point on the base or on the entire base of the closing means.

The visual humidity state indicator that changes color, according to the present invention, can be reversible or irreversible. When it is reversible, this visual humidity state indicator adopts a color that is suitable to the humidity actually corresponding to the internal atmosphere of the container body at the time of observation, which color can change from one minute to the next according to the actual change in the internal humidity. It therefore allows for an instantaneous assessment of the internal humidity.

When it is irreversible, this visual humidity state indicator develops a spot that makes it possible to determine the maximum humidity state before opening the container, allowing this observation, without providing information on the humidity level at the time of the observation.

According to the present invention, it is possible to use irreversible or reversible visual humidity state indicators alone or in combination.

Therefore, the user opening the cap by hand, in the case of a cover-cap, and positioning it in the wide-open position will immediately see the humidity state indicator and the color and physical appearance of this indicator.

It is, however, possible, according to the present invention, to also add at least one permanent visual indicator of which the color corresponds to a humidity level, placed on the internal surface of said reclosable closing means and accompanying the humidity state indicator that changes color. In the case of more than one permanent colored visual indicator, each corresponding to a humidity level, it is possible to constitute a diversely colored scale, each color indicating a humidity level, with the comparison between the color of the humidity state indicator and the colors of the scale of the permanent visual indicator making it possible to determine the humidity level present inside the container body when it is opened by the user.

It is thus possible to compare the color of the visual humidity state indicator with the at least one permanent colored indicator corresponding to a humidity level.

The visual humidity state indicator preferably comprises a humidity-indicating composition, placed on a substrate of which the coloring changes according to the level of humidity occurring or having occurred in the closed container. This substrate can be a sheet of paper, a non-woven fabric or a polymer film, which is possibly porous, possibly filled, and preferably hydrophilic, depending on the requirements of the procedure, in particular in terms of handling and attachment on the base of the reclosable closing means.

In the context of the present invention, the substrate is preferably of the paper, sheet or formulated plastic film type.

According to the present invention, the humidity-indicating composition is preferably a reactive ink having a reversible or irreversible character, of which the reactant is preferably chosen in the group of metal salts consisting of cobalt, iron, copper in the form of chloride, bromide, iodide, sulfate, thiocyanate, and phosphate. Such inks have an ability to change color under the effect of the humidity, with which the metal salts react. Such inks are known and described in the prior art, for example in U.S. Pat. No. 2,460,071 for cobalt chlorides, U.S. Pat. No. 2,460,069 for cobalt bromides, U.S. Pat. No. 2,460,073 for cobalt iodides, U.S. Pat. No. 2,460,074 for cobalt thiocyanates, U.S. Pat. No. 2,460,065 for cobalt sulfates, and U.S. Pat. No. 2,460,070 for cobalt phosphates, all of which are incorporated herein by reference.

In the case of a reversible humidity-indicating composition, the color of this composition changes according to the level of humidity to which it is subjected, whether there is an increase or decrease in this humidity content, said change in color being reversible.

In the case of an irreversible humidity-indicating composition, the color of this composition changes only in the direction of the increase, until the maximum humidity threshold, without being capable of returning to its previous color if the humidity decreases. The color observed in this case indicates the maximum humidity level of the medium in which it is present. In this case, it is generally observed that the dimension of the surface covered by the humidity-indicating composition is increased to the extent that the maximum humidity content is high, indelibly coloring the medium on which said composition is placed.

The ink-type humidity-indicating composition can be deposited on the substrate by any suitable technique, such as printing, coating, marking and ink jet or the like.

The thickness of the ink deposit can be any desired thickness and in some cases can vary from 5 to 50 micrometers and preferably from 10 to 25 micrometers.

When the ink deposit is produced by printing, it can be done by flexography, heliogravure or pad printing. It can be applied at points or continuously.

The ink can cover all or some of the substrate on which it is deposited. The printing can be provided in the form of points, zones, or continuous or non-continuous bands.

According to the present invention, it is possible to incorporate a permanent visual colored indicator corresponding to a reference humidity level, which permanent colored indicator indicates, for example, the possibly unacceptable humidity level reached.

The reference permanent visual colored indicator is constituted by the printing of at least one very precisely determined color that corresponds to the color that the humidity indicator assumes when the ink with which it is impregnated has reacted in the presence of ambient humidity.

A color scale assigned to the reference permanent visual colored indicator can indicate the progression of the humidity content until saturation, in particular that, for example, at 25%, 50%, and 75% relative humidity, or as an acceptable "percentage", or simply an unacceptable humidity level for a packaged product.

This printing constituting the reference permanent visual colored indicator is preferably performed at the same time as the printing of the humidity indicator, on the substrate.

Instructions, printed at the same time as the reference permanent visual colored indicator and preferably at the same time as the humidity indicator, making it possible to interpret the humidity state by indicating, to the user, the need to compare the indicator colors with the humidity indicator.

The color of the permanent visual colored indicator is chosen from a color scale of which the hues are correlated with pre-established humidity levels, thus making it possible, by comparing its color with the color acquired by the visual indicator of the humidity present in the ambient environment, to determine the humidity level of the atmosphere of the container.

According to the surface available at the base of the reclosable closing means, such instructions are printed, for example, in capsule segments placed around the humidity indicator, or in the form of a scale of successive circles or adjacent colored rectangles.

In a first embodiment, the connection between the humidity state indicator and the internal surface of the closing means of the container is produced by bonding. The bonding-type connection is produced by depositing a layer of thermofusible polymers, an adhesive varnish, a self-adhesive, sensitive or not to pressure, added to the substrate on the side opposite the side receiving the moisture-sensitive ink.

This connection can also be of the thermobonding type and thus be produced by the simple compatibility of the surfaces in the presence of the temperatures and injection pressure according to the "in-mould labelling" technique in particular, which constitutes a preferred embodiment because it can easily be automated.

In another embodiment, the connection between the humidity indicator and the internal surface of the closing means of the container can be produced by clipage between a relatively rigid substrate and a cavity with undercut edges provided in the base of the reclosable cover-cap-type closing means, for example. Such an operation can also be mechanised.

In all of the embodiments, a minimum rigidity of the substrate is required for reasons of handling and automation of the processes. The maximum surface of use is obviously desired.

According to the invention, the surface of the visual humidity state indicator in contact with the product to be packaged is possibly coated with a film or a transparent coating, preferably porous to steam, on all or some of its surface, the function of which is to constitute a barrier to possible diffusion, toward the packaged product, of substances that would not be on the positive list of acceptable substances for contact with food. The addition of such a film makes it possible, in particular, to avoid so-called compatibility problems, in particular with certain reactive components of the ink which is reactive to changes in humidity, such as, for example, cobalt chloride. Such a film constitutes a sort of functional barrier.

The humidity indicator constituted by a humidity-sensitive ink layer, deposited on a substrate, can possibly be protected on one and/or the other of its surfaces by a strippable impervious film, on at least one of its sides, according to the requirements for storage and production of the humidity indicator and the dehydrating container.

When the substrate receiving the humidity-sensitive ink is a film, any thermoplastic polymer material can be used and is implemented in the form of a continuous film with a low thickness ranging from 10 to 100 micrometers, except for rigidity for machine passages. Such films can be chosen from films of high- and low-density polyethylene, blown or cast, mono- or bi-oriented cast polypropylene, bi-oriented polystyrene, bi-oriented PET, cast polyamide, blown or bi-oriented, PLA, polyvinyl alcohol, polyvinyl chloride, mono- or multilayer polyvinylidene chloride, simple or themselves coated with adhesive polymers possibly formulated with mineral fillers. All of these polymers can be modified in order to create or reinforce the hydrophilic character.

When the substrate is paper, it is generally coated with a coating produced by coating or spread-coating.

The body of the dehydrating container as well as the reclosable cover-cap-type closing means according to the invention are produced by plastic processing methods suitable for their production by means of materials that are thermoplastic polymers and/or copolymers such as, for example, polyethylenes (PE), polypropylenes (PP), ethylene/propylene copolymers and mixtures thereof, polyamides (PA), polystyrenes (PS), acrylonitrile-butadiene-styrene (ABS) copolymers, styrene-acrylonitrile (SAN) copolymers, polyvinylchlorides (PVC), polycarbonates (PC), methyl polymethacrylates (PMMA), polyethyleneterephthalates (PET), implemented alone or in a mixture depending on their compatibility.

For the production of the container body and the reclosable cover-cap, and depending on the mechanical characteristics desired for said container and said cap, it is possible to combine, with said polymers and/or copolymers, at least one natural or synthetic thermoplastic elastomer. The elastomer (s) implemented can preferably be chosen from the group consisting of natural rubber-type elastomers, synthetic rubber, in particular mono-olefin rubbers, such as, for example, polymers of isobutylene/isoprene, ethylene vinyl acetate (EVA), ethylene-propylene (EPR), ethylene-propylene-diene (EPDM), ethylene acrylic esters (EMA-EEA), fluorinated polymers, diolefin rubbers, such as, for example, polybutadienes, butadiene-styrene copolymers, rubbers based on condensation products such as, for example, polyester and polyurethane thermoplastic rubbers, silicones, styrenic rubbers, styrene-butadiene-styrene (SBS) and styrene-isoprene-styrene (SIS) and the like.

The container body and the cover-cap can also be made with thermoplastics of plant origin, with the characteristic of being capable of being easily compostable, such as, for example, polylactic acids (PLA).

According to the invention, the container body and the cover-cap can be made with polymer materials of the same composition or with polymer materials of different compositions. They may or may not be formulated with mineral fillers, various adjuvants such as stabilizers, coloring agents, or stripping agents, which are well known from the prior art.

The invention also relates to the use of the dehydrating container with a reclosable cover with a visual humidity indicator, for the packaging and monitoring of the state of humidity-sensitive products when they are in a protective environmental medium of which the atmosphere must be humidity-controlled and in particular for the monitoring of agri-food, pharmaceutical or diagnostic products.

According to FIGS. 1 to 4, the impervious dehydrating container with a humidity state indicator 1 for packaging products sensitive to ambient humidity, is composed of:

- a casing 2 closed at one of its ends by a base 3, forming the container body 4 and open at the other end 5 to allow access for the purpose of packaging products sensitive to humidity,
- reclosable cover-cap-type closing means 6, secured to the container body 4 by connection means 7 of the removable mechanical hinge type,
- humidity absorption means 8,
- a visual humidity state indicator 9, positioned on the base of the reclosable cover-cap-type closing means 6,
- a permanent visual colored indicator 10 indicating a reference humidity level, which is chosen from a color scale of which the hues are correlated with pre-established humidity levels and making it possible, by comparing its color with the color acquired by the visual humidity state indicator 9, to determine the humidity level of the atmosphere of the container.

The seal between the body of the dehydrating container 1 and the cover-cap-type closing means 6 is obtained by a specific design of said closing means 6.

The cover-cap-type closing means 6 comprise two coaxial peripheral walls, one of the walls 11 being referred to as an internal wall, the other wall 12 being referred to as an external wall. The two coaxial walls create a peripheral groove 13 peripherally covering the wall of the open end of the container body 4.

When the cover-cap is in the open position, the visual humidity state indicator 9 appears in the base of the cover-cap-type closing means 6. It is associated with the permanent visual colored indicator 10 thus indicating, by comparison, the information on, for example, an unacceptable level of humidity in the internal atmosphere of the container.

Figure 4:
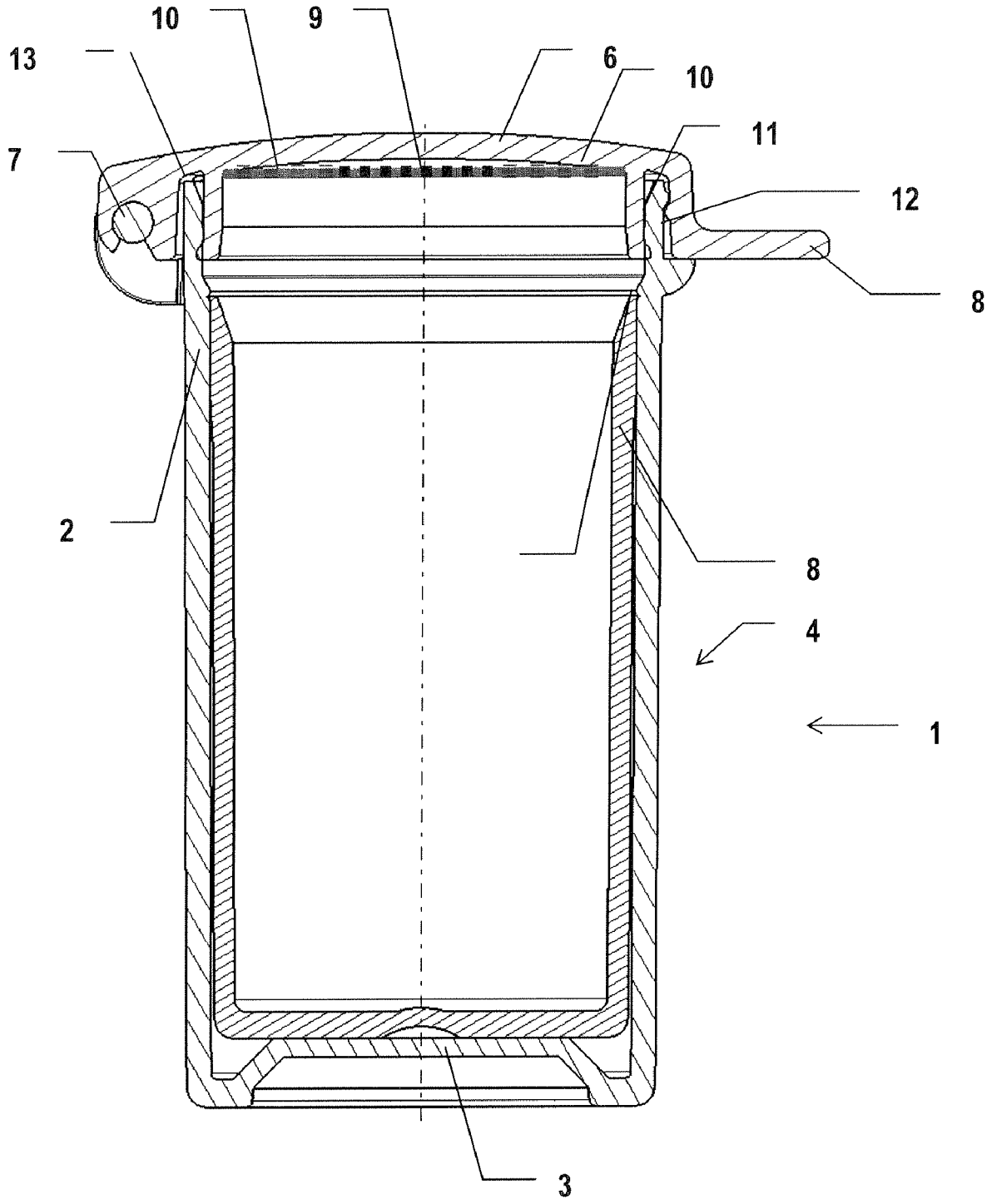
FIG. 4 is a cross-sectional view of a dehydrating container according to FIG. 1, intended for packaging humidity-sensitive products, according to the present invention, in which the cover-cap comprises, on its internal base, a visual humidity state indicator and a permanent visual colored indicator.

In the specific case of FIG. 4, which is a cross-section according to the plane of symmetry of the container of FIG. 1, the visual humidity state indicator 9 is positioned on the base of the reclosable cover-cap-type closing means 6 and the centre thereof, while the permanent visual colored indicator 10 indicating a reference humidity level is positioned as a capsule around said visual indicator.

Although the invention has been described in detail in the foregoing for the purpose of illustration, it is to be understood that such detail is solely for that purpose and that variations may be made therein by those skilled in the art without departing from the spirit and scope of the invention except as it may be limited by the claims.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

All documents referred to herein are specifically incorporated herein by reference in their entireties.

As used herein and in the following claims, articles such as "the", "a" and "an" can connote the singular or plural.

The invention claimed is:

1. A dehydrating container made of a thermoplastic polymer suitable for packaging products sensitive to ambient humidity, said dehydrating container comprising:

a container body forming a casing, closed at one of its ends by a base and open at another end thereof, a reclosable closure capable of cooperatively fitting on said open end of said casing, said closure comprising a visual humidity state indicator that changes color according to the existing humidity level and/or to a maximum humidity level, said visual humidity state indicator being located on an internal surface of said reclosable closure, a connector placed between the reclosable closure and the casing, and a humidity absorber inside said container for absorbing humidity from the atmosphere inside the container, said absorber comprising a dehydrating agent.

2. A dehydrating container according to claim 1, wherein the closure further comprises a permanent visual colored indicator for determining the level of humidity of the internal atmosphere by comparing the color of the visual humidity state indicator with the color of the permanent visual colored indicator, said permanent visual colored indicator being placed on the internal surface of said closure.

3. A dehydrating container according to claim 1, wherein the visual humidity state indicator comprises an ink composition reactive to humidity that is reversible or irreversible.

4. A dehydrating container according to claim 3, wherein the ink composition comprises at least one reactant metal salt selected from the group consisting of cobalt, iron, and copper in the form of chloride, bromide, iodide, sulfate, thiocyanate, and phosphate.

5. A dehydrating container according to claim 1, wherein a reactive ink composition is deposited on a substrate.

6. A dehydrating container according to claim 5, wherein the substrate on which the composition is deposited is selected from the group consisting of a paper, a non-woven fabric and a polymer film.

7. A dehydrating container according to claim 1, wherein the visual humidity state indicator comprises a transparent coating or film that is porous to steam on a surface thereof in contact with the product to be packaged, and wherein said coating serves as a barrier to diffusion of substances present in the reactive ink.

8. A dehydrating container according to claim 5, wherein the substrate is attached to an internal surface of the closure by bonding, an adhesive, a thermobonding and/or a mechanical connection.

9. A dehydrating container according to claim 8, wherein the substrate is attached to an internal surface of the closure by thermobonding by an in-mold labelling technique.

10. A dehydrating container according to claim 1, wherein the closure is selected from the group consisting of wedge-on caps, screw caps and cover-caps.

11. A dehydrating container according to claim 10, wherein the closure comprises a reclosable cover-cap.

12. A dehydrating container according to claim 1, wherein the closure is connected to the container body by a removable mechanical hinge connector or an integral hinge connector.

13. A dehydrating container according to claim 1, wherein the closure is secured to the container body by a hinge placed between an attachment ring and said closure.

14. A dehydrating container according to claim 1, wherein the dehydrating agent is selected from the group consisting of silica gels and molecular sieves, in the form of a powder or deposited on a powder medium.

15. A dehydrating container according to claim 1, wherein the humidity absorber comprises a dehydrating lining, fitting the inside of the container body.

16. A dehydrating container according to claim 15, wherein the humidity absorber comprises an injectable dehydrating composition comprising at least one polymer and at least one dehydrating material.

17. A dehydrating container according to claim 16, wherein the dehydrating material is selected from the group consisting of molecular sieves and silica gels.

18. A dehydrating container according to claim 1, wherein the thermoplastic polymer is selected from the group consisting of polymers and/or copolymers of ethylenes, propylenes, ethylene-propylene and mixtures thereof, polyamides, polystyrenes, acrylonitrile-butadiene-styrene copolymers, styrene-acrylonitrile copolymers, polyvinylchlorides, polycarbonates, methyl polymethacrylates, polyethyleneterephthalates, polylactic acids, and biodegradable polymers.

19. A method for packaging and/or monitoring the state of a product sensitive to humidity comprising packaging said product in a dehydrating container according to claim 1.

* * * * *